US010184312B2

(12) United States Patent
Murphy

(10) Patent No.: US 10,184,312 B2
(45) **Date of Patent: *Jan. 22, 2019**

(54) SUBSEA TREE AND METHODS OF USING THE SAME

(71) Applicant: FMC Technologies, Inc., Houston, TX (US)

(72) Inventor: Richard M. Murphy, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/599,030

(22) Filed: May 18, 2017

(65) Prior Publication Data

US 2017/0254169 A1 Sep. 7, 2017

Related U.S. Application Data

(63) Continuation of application No. 15/056,433, filed on Feb. 29, 2016, now Pat. No. 9,702,215.

(51) Int. Cl.

| | |
|---|---|
| ***E21B 33/035*** | (2006.01) |
| ***E21B 33/076*** | (2006.01) |
| ***E21B 34/04*** | (2006.01) |
| *E21B 33/04* | (2006.01) |
| *E21B 33/064* | (2006.01) |

(52) U.S. Cl.

CPC ..... *E21B 33/076* (2013.01); *E21B 33/035* (2013.01); *E21B 34/04* (2013.01); *E21B 33/0422* (2013.01); *E21B 33/064* (2013.01)

(58) Field of Classification Search

CPC .... E21B 33/035; E21B 33/043; E21B 33/076; E21B 34/04

See application file for complete search history.

(56) References Cited

U.S. PATENT DOCUMENTS

| | | | | |
|---|---|---|---|---|
| 5,010,956 A * | 4/1991 | Bednar | E21B 34/04 | 166/344 |
| 5,280,766 A * | 1/1994 | Mohn | E21B 33/076 | 166/368 |
| 5,435,338 A * | 7/1995 | Da Silva | B08B 9/053 | 137/242 |
| 6,460,621 B2 * | 10/2002 | Fenton | E21B 33/035 | 166/347 |
| 6,698,520 B2 * | 3/2004 | Fenton | E21B 33/035 | 166/347 |

(Continued)

*Primary Examiner* — Matthew R Buck

(74) *Attorney, Agent, or Firm* — Osha Liang LLP

(57) ABSTRACT

A subsea tree for use with a well includes a master block that has a flow hub located at the top of the subsea tree, a flow bore in fluid communication with the well, a swab valve, and a master valve. A choke block is coupled to a side of the subsea tree and includes a choke in a flow passage of the choke block. The swab valve is selectively closed so that fluid flowing through the master block is directed through the choke in the choke block. A method for operating the subsea tree, includes directing flow of a first fluid into the flow bore of the subsea tree, through the choke of the choke block, and then into the flow bore of the subsea tree. The method includes reversing flow of a direction of a second fluid through the subsea tree.

19 Claims, 4 Drawing Sheets

(56) References Cited

U.S. PATENT DOCUMENTS

| | | | | |
|---|---|---|---|---|
| 7,740,074 | B2 * | 6/2010 | White | C07D 263/48 166/250.01 |
| 8,011,436 | B2 * | 9/2011 | Christie | E21B 33/035 166/338 |
| 8,151,890 | B2 * | 4/2012 | Spencer | E21B 33/035 166/250.01 |
| 8,245,787 | B2 * | 8/2012 | White | E21B 33/035 166/344 |
| 8,322,442 | B2 * | 12/2012 | Voss | E21B 43/121 166/311 |
| 8,672,038 | B2 * | 3/2014 | Tan | E21B 33/035 166/338 |
| 8,763,693 | B2 * | 7/2014 | McHugh | E21B 33/076 166/250.01 |
| 8,991,503 | B2 * | 3/2015 | Fenton | E21B 33/043 166/340 |
| 9,169,709 | B2 * | 10/2015 | Vincent | E21B 43/01 |
| 9,187,980 | B2 * | 11/2015 | McHugh | E21B 33/076 |
| 2013/0098633 | A1 * | 4/2013 | Fenton | E21B 43/0122 166/382 |
| 2014/0262306 | A1 * | 9/2014 | Hosie | E21B 33/038 166/336 |

* cited by examiner

SUBSEA TREE AND METHODS OF USING THE SAME

CROSS-REFERENCE TO RELATED APPLICATIONS

This application claims benefit under 35 U.S.C. § 120 to U.S. patent application Ser. No. 15/056,433, filed on Feb. 29, 2016, this application is incorporated by reference herein in their entirety.

BACKGROUND

A tree (also known as a Christmas tree) is a complex configuration of actuable valves and other components. They may be used onshore or offshore. Subsea trees are currently operating offshore at every water depth, and are increasingly being used in deeper waters. Additional challenges exist with subsea trees by virtue of being used in a marine environment.

In oil and gas operations, subsea trees may be mounted on top of either injection wells or production wells. An injection well as understood in the art is a well in which fluids are injected rather than produced. Fluid injection into a producing zone of a reservoir is used as an element of reservoir management and may be used to increase oil recovery. The fluids injected into a well may be either liquid or gaseous.

One of the main objectives of injection wells is typically to maintain reservoir pressure or assist in the recovery of oil and or gas by increasing reservoir pressure. Water injection is one type of fluid injection technique that involves drilling injection wells into a reservoir and introducing water into that reservoir, for example, to encourage oil production. Whether water injection occurs before or after production has already been depleted, water injection helps to sweep remaining oil through the reservoir to production wells, where it can then be recovered.

In a production well, produced oil and gas flowing from a reservoir is directed through tubing to the surface and collected for further refining and distribution. A production tree may be useful in controlling and regulating the flow of the oil and gas flowing from a reservoir.

The primary function of a tree is to control the flow of fluids into and out of a well, depending on whether it is an injection well or a production well. However, trees can also include other functionality to allow for troubleshooting, well servicing, etc.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one embodiment of the present disclosure, a subsea tree may be configured for use with a well. The subsea tree may include a master block, the master block including a flow hub disposed at a top of the subsea tree and a flow bore in fluid communication with the well. The subsea tree may further include a swab valve and a master valve disposed on the master block. A choke block may be disposed on a side of the tree, wherein the choke block includes a choke disposed in an upper conduit or a lower conduit of the choke block, wherein the upper conduit and the lower conduit are in fluid communication with the master block and the choke.

The swab valve may be configured to be selectively closed so that fluid flowing through the flow bore of the master block may be directed through the choke in the choke block.

In another embodiment, a method for injecting fluid into a reservoir may include injecting fluid through an opening of the subsea tree, wherein the subsea tree may include a flow bore in fluid communication with a flow bore of a well. The method may further include redirecting the injected fluid from the flow bore to a choke, directing the injected fluid from the choke hack into the flow bore of the subsea tree, and routing the injected fluid through the flow bore of the subsea tree into the flow bore of the well. The injected fluid may flow from the well into the reservoir.

In yet another embodiment, a method for producing reservoir fluid from a production well may include directing the reservoir fluid from the reservoir through a flow bore of a subsea tree, wherein the flow bore is in fluid communication with the flow bore of a tubular in the production well. The method may further include redirecting the reservoir fluid from the flow bore to a choke, directing the reservoir fluid from the choke back into the flow bore of the subsea tree, and routing the reservoir fluid from the flow bore of the subsea tree to an opening of the subsea tree.

In yet another embodiment, a method for operating a subsea tree includes flowing a first fluid produced from a flow bore of a well in an upwards direction through a flow bore of the subsea tree. The method may further include flowing the first fluid from the flow bore of the subsea tree through a choke disposed in a choke block, wherein the choke block is disposed on a lateral side of the subsea tree, flowing the first fluid from the choke block to the flow bore of the subsea tree and upwardly towards a top opening of the subsea tree, and reversing a direction of flow through the subsea tree. The reversing may further include injecting a second fluid into the top opening of the subsea tree, flowing the second fluid down through the flow bore of the subsea tree to the choke block, flowing the second fluid through the choke in the choke block, and flowing the second fluid front the choke block to the flow bore of the subsea tree and down into the flow bore of the well.

Other aspects and advantages of the claimed subject matter will be apparent from the following description and the appended claims.

DETAILED DESCRIPTION

Figure 1:
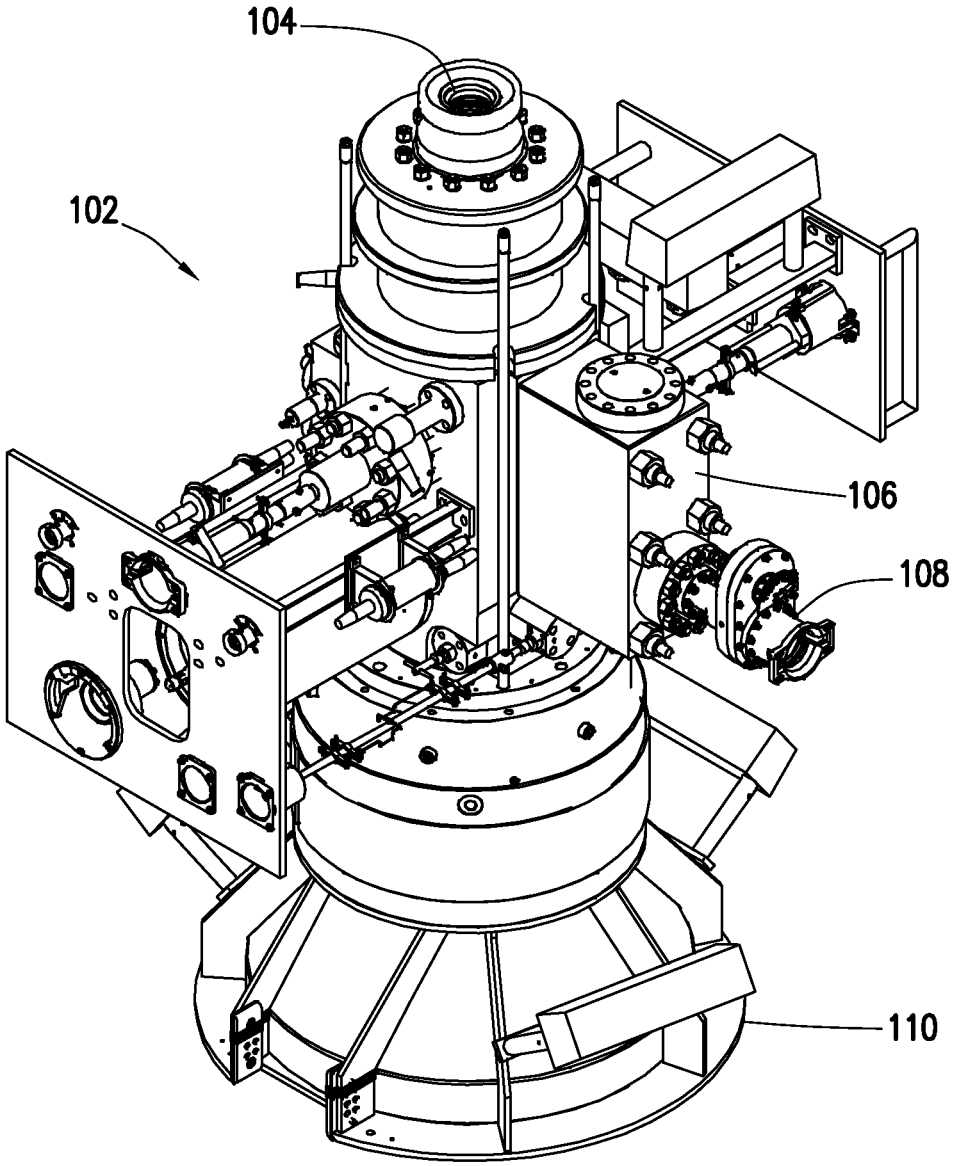
FIG. 1 shows a perspective view of a subsea tree according to embodiments of the present disclosure.

Embodiments of the present disclosure will be described below with reference to the figures. In one aspect, embodiments disclosed herein relate to an apparatus and methods for controlling and regulating the flow of fluids using a subsea tree.

Different embodiments disclosed herein describe one or more subsea trees that that control and regulate the flow of fluids for purposes of either injecting fluid into an injection well or recovering hydrocarbons (i.e. reservoir fluid) from a production well. It is recognized by the different embodiments described herein that a subsea tree plays a valuable and useful role in the life of a well. Further, it is recognized that the fluid flow configuration and arrangement of components for a subsea tree according to one or more embodiments described herein may provide a cost effective alternative to conventional subsea trees.

According to embodiments of the present disclosure, a subsea tree may include a master block having a top opening and a vertical flow bore in fluid communication with a well. A swab valve and a master valve may be disposed on the master block and a choke block may be disposed on a side of the tree. The choke block includes a choke disposed in a flow passage of the choke block and an upper and lower conduit providing fluid to/from the choke. The upper and lower conduits of the choke block may be in fluid communication with the master block and provide fluid communication between the master block and choke. The swab valve may be configured to be selectively closed so that fluid flowing through the flow bore of the master block may be directed through the choke in the choke block.

In accordance with other embodiments, methods for injecting fluid into a reservoir and producing fluid from a reservoir may include flowing fluid through a subsea tree, wherein the subsea tree may include a flow bore in fluid communication with a flow bore of a well. The methods may include redirecting the injected or produced fluid from the flow bore to a choke, directing the injected or produced fluid from the choke back into the flow bore of the subsea tree, and routing the injected or produced fluid from the flow bore of the subsea tree to the flow bore of the well or an opening of the subsea tree, respectively.

In yet other embodiments, a method for operating a subsea tree includes flowing a produced fluid from a flow bore of a well i through a flow bore of the subsea tree. The method may further include flowing the produced fluid from the flow bore of the subsea tree through a choke disposed in a choke block, wherein the choke block is disposed on a lateral side of the subsea tree. The produced fluid flows from the choke block to the flow bore of the subsea tree and upwardly towards a top opening of the subsea tree. The method further includes reversing a direction of flow through the subsea tree. The reversing may include injecting an injection fluid into the top opening of the subsea tree and flowing the injection fluid down through the flow bore of the subsea tree to the choke block and through the choke in the choke block. The injected fluid flows from the choke block to the flow bore of the subsea tree and down into the flow bore of the well. In one or more embodiments, the reversing the direction of flow through the subsea tree may be accomplished without reconfiguring the choke in the choke block or the choke block. In other embodiments, the choke within the choke block may be reoriented or the choke block may be removed and replaced with a choke block having a different choke or having a different orientation or positioning of a choke.

As used herein, the term "coupled" or "coupled to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

Turning to FIG. 1, FIG. 1 shows a perspective view of a subsea tree according to embodiments described herein. FIG. 1 is a simplified elevation view and one of ordinary skill will understand that additional components may be added or used in conjunction with the subsea tree 102 shown in FIG. 1.

In one or more embodiments, subsea tree 102 is an assembly of one or more tubulars, valves, and other components that may be configured to operate in conjunction with a subsea well. Subsea tree 102 may include at least one generally cylindrical tubular with one or more flow bores located internally within subsea tree 102. In one or more embodiments, subsea tree 102 is coupled to a wellhead of a subsea well (wellhead shown in FIGS. 3 and 4). Those of ordinary skill in the art will appreciate that there are many techniques and methods which may be used to couple subsea tree 102 to a subsea wellhead that may be applicable to the embodiments described herein, including, using a tree connector.

Figure 2:
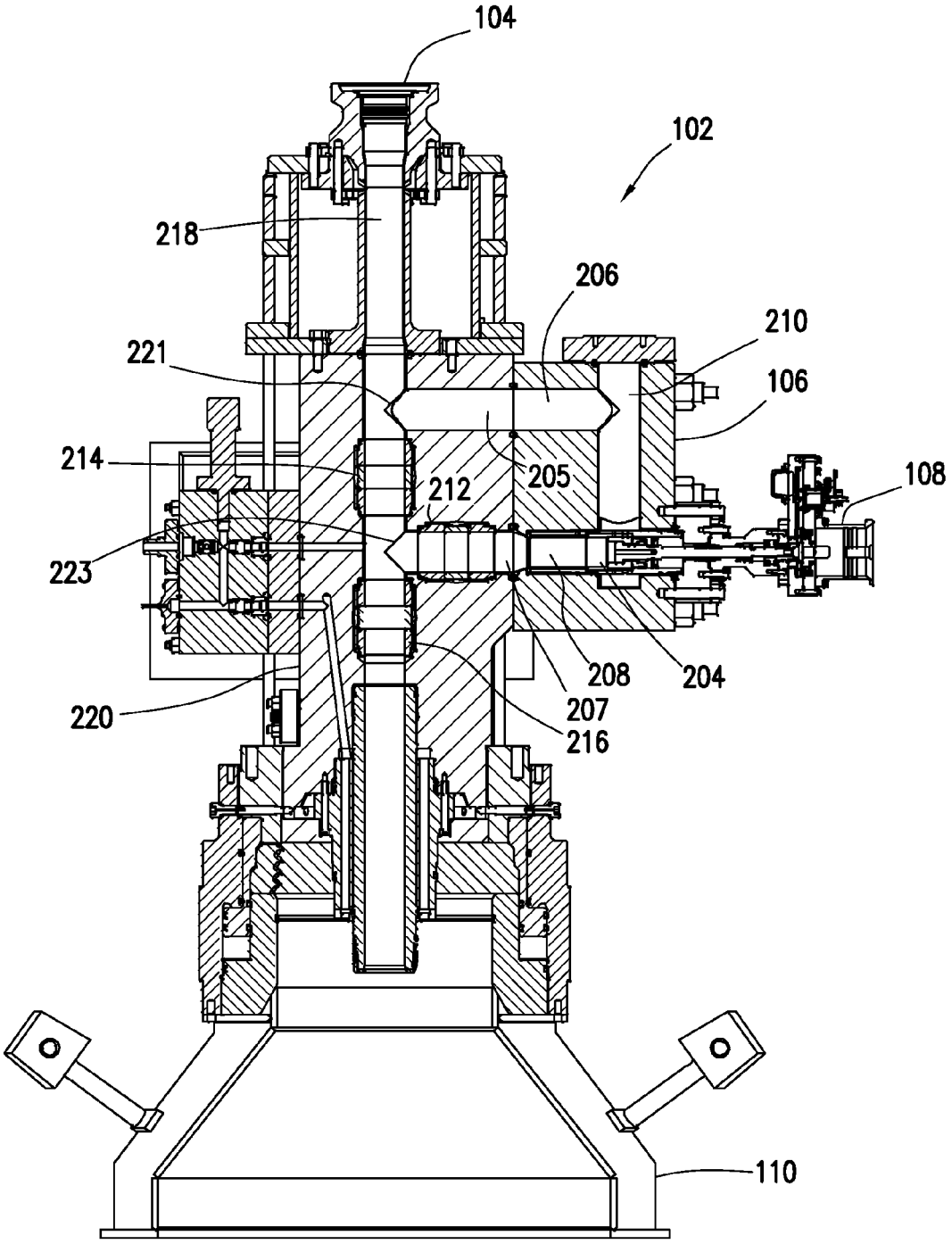
FIG. 2 shows a sectional side view of a subsea tree according to embodiments of the present disclosure.
Figure 3:
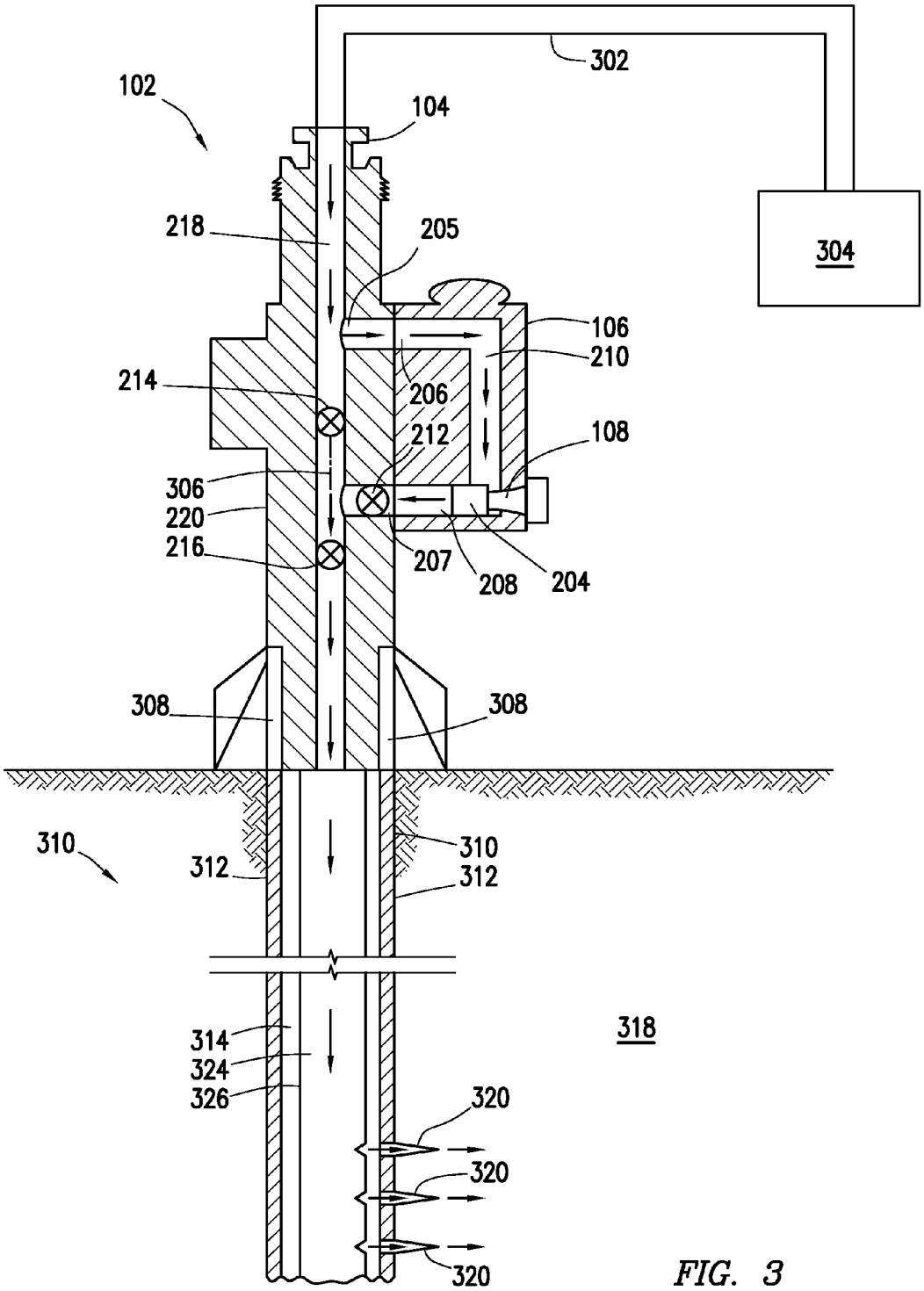
FIG. 3 is a diagram of a subsea tree configured to operate with an injection well according to embodiments of the present disclosure.
Figure 4:
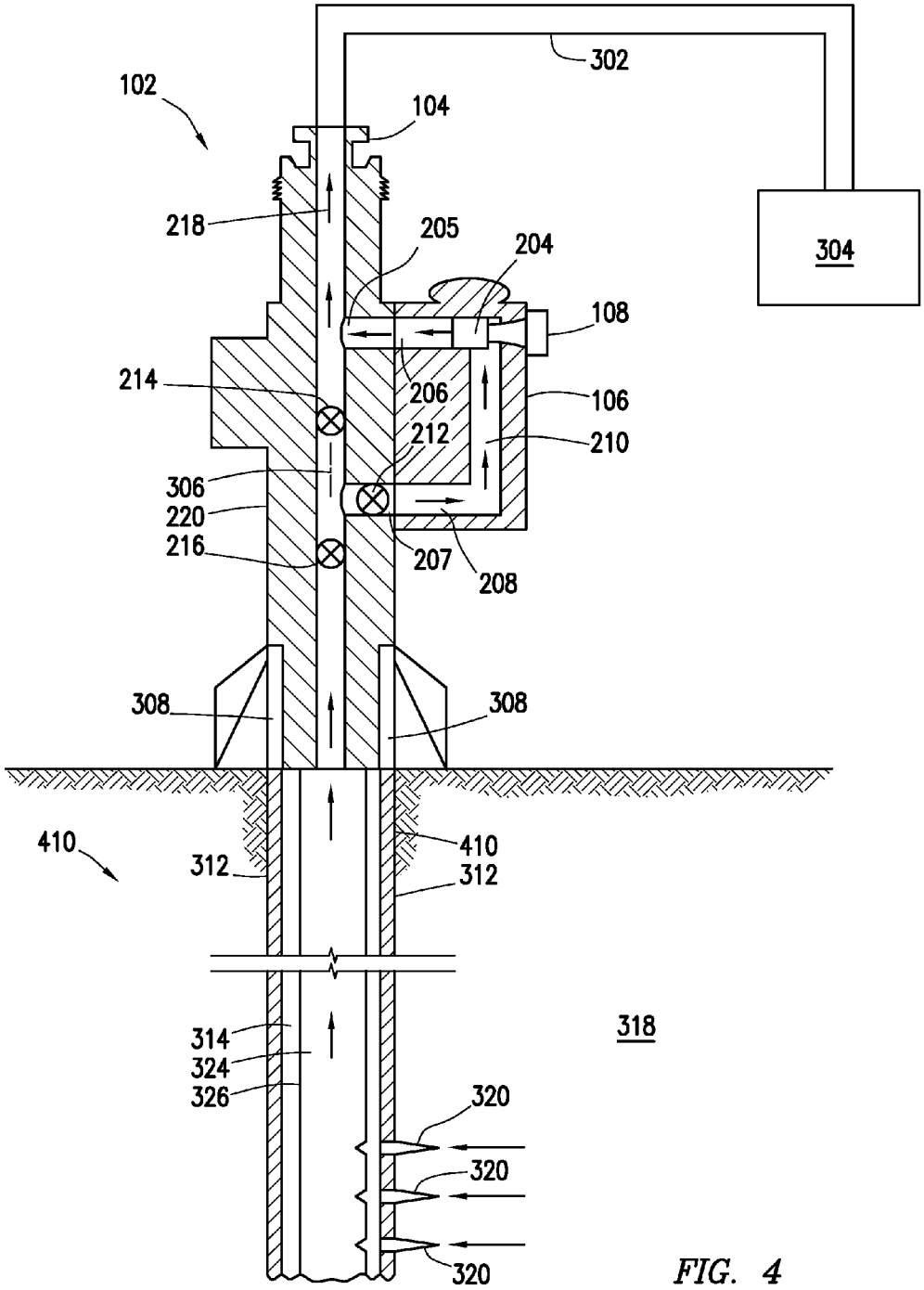
FIG. 4 is a diagram of a subsea tree configured to operate with a production well according to embodiments of the present disclosure.

Subsea tree 102 shown in FIG. 1 is an example of a vertical subsea tree. A vertical tree, such as subsea tree 102, may have at least one main vertical flow bore (e.g. flow bore 218 as shown in FIG. 2). In one or more embodiments, the subsea tree 102 is landed or located above a well, and the vertical flow bore of subsea tree 102 may be in fluid communication with a flow bore of the well (e.g. flow bore 324 as shown in FIGS. 3 and 4). Further, in one or more embodiments, the vertical flow bore of subsea tree 102 may be concentric with the flow bore of a well.

As will be recognized by those skilled in the art, subsea tree 102 may take other forms or have other features. For example, subsea tree 102 may have a non-vertical, e.g. horizontal flow bore and opening, instead of the vertical flow bore internal to subsea tree 102 and hub 104 shown in FIG. 1. Thus, those of ordinary skill will appreciate that the present embodiments may be altered and are not limited to the illustrative configurations of subsea tree 102 depicted in the attached drawings.

Subsea tree 102 in FIG. 1 includes a top opening shown as flow hub 104. In one or more embodiments, subsea tree 102 may be described as a top flow tree because of the inclusion of a flow hub 104 at the top of subsea tree 102 and the lack of a lateral flow opening. Fluids may be directed into and out of subsea tree 102 through flow hub 104. Accordingly, flow hub 104 may serve as either an inlet or an outlet depending on whether fluid is conducted into or out of a vertical flow bore of subsea tree 102.

In one or more embodiments, a flow line jumper (e.g. flow line jumper 302 as shown in FIG. 3 and FIG. 4) may be connected to flow hub 104. As understood in the art, a flowline jumper may be one or more segments of flexible pipe with a connector piece at either end. Flowline jumpers may be used to connect flowlines and/or subsea facilities together. Accordingly, subsea tree 102 provides one or more interfaces for interfacing with flowlines as well as other subsea components and facilities. Such subsea components may include, without limitation, one or more sleds, manifolds, pumps, and any other equipment useful in the operation of a well and subsea drilling/production facility.

FIG. 1 shows that a set of bolts are used to connect flow hub 104 to a top surface of subsea tree 102. Removal of flow hub 104 is possible for repairs or other purposes by unbolting the set of bolts included on hub 104. Other methods of connecting flow hub 104 to subsea tree 102 may be used as well. For example, flow hub 104 may include a flanged connection for operatively connecting hub 104 to a top of subsea tree 102. Accordingly, in one or more embodiments, hub 104 may be removed and replaced with other hubs having different sizes/shapes. Thus, different sized hubs may be separately or interchangeably used on the same subsea tree 102, thus providing greater versatility in the use of subsea tree 102 and types of equipment that may connect to the subsea tree 102.

In one or more embodiments, subsea tree 102 may be adapted for use as an injection tree (as shown in FIG. 3) or may be adapted for use as a production tree (as shown in FIG. 4). As further described below, an injection tree may be used to inject fluids into a well bore. A production tree may be used to control and provide a controlled flow path for hydrocarbons to be brought up from a reservoir and directed to other collection sites. Accordingly, subsea tree 102 may be used to safely control the flow of fluid produced by a production well or injected into an injection well, in part, by means of the assembly of valves disposed in and around subsea tree 102.

In one or more embodiments, when subsea tree 102 is coupled to an injection well, fluids may be conducted into flow hub 104 and into a vertical flow bore of the subsea tree 102 from a connected flow line jumper. In other embodiments, when subsea tree 102 is adapted for use with a production tree, a flow line jumper may be connected to conduct the outgoing fluid (oil and/or gas) produced from a subsea wellhead. The outgoing produced fluid may be subsequently collected at various collection devices or distributed for further treatment once distributed from the hub 104 of subsea tree 102.

It is noted that in addition to the injection of fluids or directing of outgoing fluids in a production well, subsea tree 102 may also be utilized to monitor various well parameters. Subsea tree 102 may include other functions known to those of ordinary skill in the art.

A control system (not shown) controlling the subsea tree may be implemented and operated by an associated operator to include a combination of automatic and manual controls for controlling subsea tree 102 and various components thereof. Further, any of the controls and valves disposed on subsea tree 102 may be configured to be actuable or manipulated by a diver, an ROT (remotely operated tool), or an ROV (remotely operated vehicle). Alternatively, the tree valves may be hydraulically or electrically actuated valves.

In one or more embodiments, subsea tree may be handled and deployed to and from a well from a wide variety of MODUs (Mobile Offshore Drilling Units), MSVs (Multipurpose Service Vessels), and AHVs (Anchor Handling Vessels) by wireline operations.

In one or more embodiments, subsea tree 102 includes a funnel down interface 110 that may be used to couple subsea tree 102 to a wellhead and may further include flow hub 104 provided on the top of the subsea tree to interface with a tree running tool as well as a flowline jumper. Further, alternative alignment and connection mechanisms, such as gyroscopes, and tools, such as ROVs, may be utilized as well.

Offshore wells usually include a tubing hanger system for suspending tubulars in an installed well. In one or more embodiments, tubing hanging for suspending tubulars used in either an injection well or a production well may be coupled directly to subsea tree 102. In alternative embodiments, tubing hanging may be installed within a wellhead below subsea tree 102. Alternatively, additional tubing head or spool may be located above a subsea wellhead of subsea tree 102. The tubing hanger may be landed or positioned using a variety of known techniques. U.S. Pat. No. 7,296,629, incorporated for reference purposes herein in its entirety, is assigned to the present assignee and includes examples of techniques and configurations for positioning a tubing hanger in a subsea tree. Those of ordinary skill will appreciate that the tubing hanger may be installed using any of the methods and apparatuses of U.S. Pat. No. 7,296,629 as well as other methods and apparatuses known the art.

It is further noted that in one or more embodiments, subsea tree 102 may incorporate an "H4" connection profile, which is a subsea wellhead profile known in the industry. In one or more embodiments, a blowout preventer (BOP) as known in the art) may be landed on top of and coupled to a subsea tree having an H4 connection profile. Incorporating a BOP on top of subsea tree 102 may be useful for containing downhole pressures as well as during workovers. As known in the art, a workover is used to refer to any kind of oil well intervention involving invasive techniques, such as wireline, coiled tubing or snubbing. It may also refer to the process of performing major maintenance or remedial treatments on an oil or gas well, including removal and replacement of production tubing or other tubing placed in a well, which sometimes occurs when a well has been killed and is converted to an injection well. FIGS. 3 and 4 generally show a H4 connection profile, however, those of ordinary skill in the art will appreciate that subsea tree 102 is not limited to having such a connection profile. Other subsea wellhead profiles may be used as known in the art.

According to one or more embodiments described herein, subsea tree 102, as shown in FIG. 1, includes choke block 106. Choke block 106, as pictured in FIG. 1, may be a block located externally to the vertical bore of subsea tree 102. Choke block 106 may be located on a lateral side of subsea tree 102. It is noted that choke block 106 may be disposed on any side of subsea tree 102 to fit a suitable design of the overall structure. In one or more embodiments, choke block 106 may be integrated into a main or master block (i.e., body) of subsea tree 102.

Accordingly, choke block 106 may be integrated into the master block so that there is a single body or it may be integrated as a separately retrievable or non-retrievable module into the main block of subsea tree. In one or more embodiments, choke block 106 may be integrated into subsea tree 102. Alternatively, chock block 106 may be connected through a flanged connection to subsea tree 102. In other embodiments, choke block 106 may be bolted to subsea tree 102. Other techniques known in the art may be further be used to connect choke block 106 to subsea tree 102.

Choke block 106 may act as a housing for one or more chokes and/or conduits (shown in FIG. 2) or passage ways for fluid to flow through. Choke block 106 further includes at least one flow bore within choke block 106 for fluid to flow through. Choke block 106 may further include a choke actuator 108 disposed on choke block 106 for actuating one or more chokes included in choke block 106.

Being that subsea tree 102 is operational in a marine environment, subsea tree 102 may be subjected to external surrounding pressure at the particular underwater depth that subsea tree 102 may be located. Historically, pressure ratings of subsea trees are standardized between 5000 psi (34.5 MPa) to about 15,000 psi (103.5 MPa). More recently, as offshore wells are dug to explore and cultivate oil and gas reservoirs at deeper depths, the pressure load on subsea trees continues to increase and may often reach or exceed 20,000 psi (138 MPa). In one or more embodiments, subsea tree 102 may be configured to withstand and operate at any depth and any pressure without limitation to the pressure ratings listed above. Further, those of ordinary skill in the art will also appreciate that subsea tree 102 may be designed and configured to operate at any underwater temperature. Additionally, in some embodiments, subsea tree 102 while located on the sea floor, may be exposed to sea water while in other embodiments, subsea tree 102 may be enclosed in an air filled chamber.

Turning to FIG. 2, FIG. 2 shows a sectional view of a subsea tree according to one or more embodiments. Subsea tree 102 shown in FIG. 2 may operate in accordance with the description of subsea tree 102 as described above in FIG. 1.

Subsea tree 102 in FIG. 2 includes choke block 106, which may operate in accordance with the description provided above in FIG. 1. In one or more embodiments, a choke 204 (not explicitly pictured) may be disposed in an upper conduit or a lower conduit of choke block 106 as further discussed in detail below. As shown in FIG. 2, choke 204 is coupled to actuator 108, which is further discussed below. As known in the art, a choke is a flow control device that may be used to control the flow rate of a fluid (liquid or gas) during injection or production operations. Choke 204 may be described as a restriction (e.g. an orifice) in a flow line or flow path of fluid that causes a pressure drop and/or reduces a rate of flow. Typically, chokes, such as choke 204, use a partially blocked orifice or flow path. By blocking the flow path, fluid flow rate may be reduced and a pressure drop may occur as fluid flows over the restriction. The pressure drop that occurs over the orifice of the choke may be a parameter of particular importance for selecting a suitable choke.

Accordingly, choke 204 may be used to control the flow rate of entering or exiting fluid in flow bore 210 of choke block 106. Further, choke 204 may be used to control pressure of fluid entering or exiting choke 204, which in turn, regulates the pressure of fluids as they enter or exit a flow bore of subsea tree 102 and of a corresponding well. The pressure drop and recovery of fluids that may pass through choke 204 are parameters of particular importance to operators of a well and are carefully monitored.

Choke 204 may include a choke body that may be permanently or not permanently fixed to choke block 106. One or more seals and retention mechanisms (such as a clamp or crown or bonnet) may be used to hold choke 204 in place. Further, one or more actuators, such as choke actuator 108 may be used to actuate or operate choke 204. As illustrated in FIG. 2, choke actuator 108 may be disposed on one side of choke block 106 and may include one or more actuating mechanisms. Further, FIG. 3 and FIG. 4 illustrate that actuator 10$ may be coupled to choke 204 such that choke 204 may be attached to actuator 108. In one or more embodiments, choke 204 may be either a fixed choke or adjustable choke. A fixed (also known as positive) choke conventionally has a fixed aperture (orifice) used to control the rate of flow of fluids. An adjustable (or variable) choke has a variable aperture (orifice) installed to restrict the flow and control the rate of production from the well. Those of ordinary skill in the art will appreciate that choke 204 may be actuated via choke actuator 108 and one or more mechanisms through different methods including electric and hydraulic actuators. For example, choke 204 disposed in choke block 106 may be mechanically adjusted by a diver, or may be adjusted remotely from a surface control console, and also using a remotely operated vehicle (ROV).

Several variables and measurements may need to be known to select a proper choke suitable for either a subsea injection tree or production tree. For example, it may be desirable to know the velocity or rate of the flow coming into a choke, an inlet pressure of the flow, the pressure drop that occurs crossing a choke orifice, and the outlet pressure of the flow. Part of the selection process of a choke takes into consideration the size of the orifice in the choke and direction changes that may affect fluid flow in a choke. Other relevant flow data may be collected regarding fluid density and inlet and outlet temperature of the fluid. Further, it may be useful to know what flow constituents or particles may be included in the liquid as well as the concentrations and composition of any such flow constituents. Liquid hydrocarbons or oil often contains solids and other constituents, including sand, that affect the overall operation and span of use of choke 204 and other internal components of choke block 106.

Various factors are also taken into consideration when selecting a suitable choke trim. Choke trim as understood in the art may be a pressure-controlling component of a choke and actually controls the flow of fluids. Choke trim design types include, without limitation, needle and seat, multiple orifice, fixed bean, plug and cage, and external sleeve trims. In accordance with one or more embodiments, choke 204 may incorporate any choke trim suitable for the optimal performance and control of the fluid expected to flow into and out of choke block 106. Sizing of the choke 204 may also depend on a myriad of factors unique to the type of fluid flowing through choke 204. Choke block 106 may include any type of choke as understood in the art and be of any size useful for the specific flow parameters of subsea tree 102.

As fluid flows through a choke, various conditions begin to naturally occur over time due to the particular characteristics of the fluid flow. Such conditions may include, without limitation, erosion, cavitation, abrasion, and/or freezing due to the temperature variables of the fluid at the choke. Over time such conditions may lead to wear on the internal components of a choke and may ultimately lead to a failure of the choke. Regular maintenance and monitoring of the condition of choke 204 and internal components of choke block 106 are usually required. Nevertheless, even with regular maintenance, choke block 106 and one or more of internal components may eventually fail due to the various conditions discussed above and may eventually need replacement.

As known in the art, chokes may include inserts that are used to restrict the flow of fluids. Choke inserts, as understood in the art, may be non-retrievable or retrievable. Non-Retrievable choke inserts are permanently mounted to a structure, such as a subsea tree 102 and are not independently retrievable when maintenance or removal of the non retrievable choke insert becomes necessary. An operator of a subsea tree, such as subsea tree 102, may take into consideration whether to include a retrievable or non-retrievable choke inserts in the design of a choke block, such as choke block 106. Any repair or replacement of the non-retrievable choke usually involves shutting down the flow of fluid in the subsea tree 102 and recovery of the entire subsea tree 102 structure to the surface for repair or maintenance.

On the other hand, retrievable choke inserts are self-contained packages that may be replaced or repaired without removing the entire corresponding subsea tree structure, i.e. retrievable choke inserts are independently retrievable. Retrievable choke inserts thus have the capability to be disassembled while still installed on the tree and pulled up to the surface for troubleshooting purposes or removal or replacement. For example, in some embodiments, a retrievable insert choke design allows the choke body to remain permanently fixed to subsea tree 102 while the trim, actuator, and retention mechanism may be retrieved as a self-contained package to the surface.

Retrievable choke inserts may reduce periods of downtime where a well may be shutdown. For a production well that is producing flowing oil and/or gas, it becomes of greater importance to minimize any such periods of downtime whereby a production well is not operational due to repair or maintenance of a subsea tree, such as subsea tree 102.

Accordingly, in one or more embodiments, subsea tree 102, when coupled to a production well, may include a retrievable choke insert for choke 204. Additionally, in one or more embodiments, subsea tree 102, when coupled to an injection well, may include a non-retrievable choke insert for choke 204. Nevertheless, those of ordinary skill will appreciate that, in some applications, retrievable choke inserts may instead be included when subsea tree 102 is coupled to an injection well and a non-retrievable choke insert may instead be included when subsea tree 102 is coupled to a production well.

Subsea tree 102 includes a vertical flow bore 218 that is adapted to provide a flow path, for the production of hydrocarbons (oil and/or gas) from a production well. In other embodiments, when subsea tree 102 is utilized in conjunction with an injection well, flow bore 218 may provide a flow path for the injection of fluids into the well.

Flow bore 218 defines flow hub 104 located at a top of subsea tree 102, Flow bore 218 may also include a centerline (illustrated as centerline 306 in FIGS. 3 and 4). In one or more embodiments, flow bore 218 is a vertical flow bore and axially disposed at a substantially central axis of subsea tree 102. While FIG. 2 illustrates subsea tree 102 as being a mono bore vertical tree, those of ordinary skill will appreciate that in other embodiments, subsea tree 102 may be configured as a dual bore subsea tree or other configurations known in the art. Further, in one or more embodiments, subsea tree 102 may be adapted to include an annulus passage way for one or more valves or access to an annulus in a well.

As shown in FIG. 2, a swab valve 214 may be disposed along flow bore 218. A swab valve, as known in the art, is the top most valve on subsea tree 102 and provides vertical access to the well bore of a well (e.g., wells 310 and 410 in FIGS. 3 and 4) located beneath subsea tree 102. Alternatively, a plug as known to those of ordinary skill in the art may be utilized instead of a swab valve 214.

Master valve 216 may also be disposed along the vertical flow bore 218 of subsea tree 102. A master valve, such as master valve 216, is a lower most valve along the vertical flow bore 218. In one or more embodiments, master valve 216 may control all flow from the well. While FIG. 2 shows a single master valve 216, in some embodiments, a second master valve may be fitted to subsea tree 102. In such embodiments, the upper master valve may be used on a routine basis, and the lower master valve may provide backup or contingency function in the event that the upper master valve is leaking and/or needs replacement.

In one or more embodiments, swab valve 214 and master valve 216 may be integrated into a master block 220 of subsea tree 102. Master block 220 refers to a main body of subsea tree 102. In one or more embodiments, choke block 106 is disposed on lateral side of master block 220. However, those of ordinary skill in the art will appreciate that alternative configurations may be possible and choke block 106 may be integrated into master block 220 of subsea tree 102.

In one or more embodiments, a wing valve 212 is included on subsea tree 106. Wing valve 212 may be located on the side of subsea tree 106 and may also be used to control or isolate fluid flow, particularly during production, through the choke 204. In the illustrated embodiment shown in FIG. 2, wing valve 212 is integrated into master block 220. In one or more embodiments, wing valve 212 may be optionally included and may not be necessary, thus simplifying a design of subsea tree 102. In other embodiments, wing valve 212 may be located in choke block 106 instead of master block 220. In such embodiments, wing valve 212 may be located in conduit 208 of choke block 106.

As shown in FIG. 2, subsea tree 102 includes upper conduits 205 and 206. Upper conduit 205 may be disposed on a master block 220 of subsea tree 102. Upper conduit 205 may be a passage way for fluid to flow through. As shown in FIG. 2, upper conduit 205 aligns with upper conduit 206, which is disposed on choke block 106 and is in fluid communication with upper conduit 206. In other words, in one or more embodiments, upper conduit 205 originates in master block 220 and has an opening at either end. Entrance 221 of upper conduit 205 connects to flow bore 218 and allows fluid from flow bore 218 to flow into upper conduit 205. A process, in accordance with one or more embodiments, for fluid to flow through upper conduit 205 and 206 is further described in FIGS. 3 and 4.

Lower conduit 207 may be disposed on master block 220 and may also connect to flow bore 218 in a manner similar to upper conduit 205. Lower conduit 207 is not clearly shown in FIG. 2 due to the presence of an optional wing valve 212. However, it is intended that in in one or more embodiments, lower conduit 207 may be coupled to vertical flow bore 218 at an entrance 223. Further, it is intended that lower conduit 207 on subsea tree 102 be aligned and in fluid communication with lower conduit 208 disposed on choke block 106.

In one or more embodiments, upper conduits 205 and 206 may be located upstream of swab valve 214. Lower conduits 207 and 208 may be located downstream of swab valve 214, but upstream of master valve 216. This configuration of the conduits in subsea tree 102 may provide a flow path for fluid to flow when swab valve 214 may be closed, as further described in FIGS. 3 and 4 below.

Turning to FIG. 3, FIG. 3 shows a diagram of a subsea tree adapted to inject fluids into a well and an adjacent reservoir. Accordingly, subsea tree 102 as shown in FIG. 3 may be utilized for injection services into an injection well, i.e. injection well 310. Injecting fluid into a reservoir, such as reservoir 31$, via the subsea tree 102 may assist in moving existing oil and/or gas contained in reservoir 318 to other production wells for further recovery. Fluid injection may be used as part of reservoir management to address issues, such as reservoir pressure depletion, high oil viscosity, or even may be employed early in an oil field's life to promote optimal production.

If pressure in a conventional production well depletes and it is considered economically viable, injection wells may be either drilled at a desired location or selected from old production wells adjacent to a reservoir in order to inject fluids into a reservoir. Accordingly, in one or more embodiments, injection well 310 may be an older production well that has been retrofitted to operate as an injection well or may be drilled specifically as an injection well at a site of particular interest.

As illustrated in FIG. 3, a flow path according to one or more embodiments is provided for injecting fluid from flow hub 104 of subsea tree 102 down into reservoir 318. Accordingly, as shown by the arrows meant to indicate the direction of fluid flow, in one or more embodiments, fluid may be directed downwardly through flow hub 104 and into flow bore 218 of subsea tree 102. It is noted that fluid injection into subsea tree 102 may include liquids or gases elements of any type or composition. In one or more embodiments, the principle component of the injected fluid is water. Additionally, in some embodiments, the injected fluid may be a mixture of fluids and chemicals.

In one or more embodiments, fluid may be conducted into flow hub 104 using flow line jumper 302. Flow line jumper 302 may connect to the flow hub 104 via a flow line jumper connector, which in one embodiment engages flow bore 218 along the centerline 306 of subsea tree 102. Flow jumper 302 may be of any desired structure and may be of any desired configuration. As shown in FIG. 3, flowline jumper 302 may connect or extend laterally to another subsea component 304. Subsea component 304 may be any type of subsea component, including without limitation, a pump unit, a sled, a manifold, or any other piece of equipment suitable for operation with the fluid injection services performed on subsea tree 102. Further, flow line jumper 302 may extend to a separate fluid injection component located on a surface vessel or platform. In one or more embodiments, fluid may be injected into flow bore 21$ of subsea tree 102 using flow line jumper 302.

In one or more embodiments, prior to directing the fluid into flow bore 218 of the subsea tree 102, swab valve 214 may be closed so that fluid injected into flow bore 218 may be diverted from vertical flow bore 218 of the main block 220 to choke block 106. Alternatively, a plug may be used instead of swab valve 214 to divert flow through choke 204 of choke block 106. In one or more embodiments, when swab valve 214 is closed, fluid may flow from upper conduit 205 of master block 220 into upper conduit 206 of choke block 106. As previously discussed, upper conduits 205 and 206 are aligned and in fluid communication. Accordingly, as presented herein, a flow path is provided for fluid to pass through the conduits disposed on master block 220 to reach a vertical flow bore 210 of choke block 106.

In accordance with one or more embodiments, swab valve 214 acts as a diverter or bypass valve. In one or more embodiments, swab valve 214 may be closed prior to the fluid injection takes place. Further, master valve 216 may be opened prior to the injecting of fluids into injection well 310 occurs. It is noted that it may be important that master valve 216 is opened prior to injecting fluid into flow bore 218. Usually, a master valve 216 may not be opened or shut while fluid is flowing through a corresponding flow bore except in very specific or very controlled circumstances.

Once swab valve 214 is closed, fluid flows through conduit 205 on master block 220 of subsea tree 102 to reach conduit 206 of choke block 106. The fluid may then continue to flow down through vertical flow bore 210 of choke block 106. In one or more embodiments, one or more chokes, such as choke 204, may be located in a lower conduit, such as lower conduit 208. Choke 204 is located in a junction of lower conduit 208 and flow bore 210 such that choke 204 is located in a in a lower most area of flow bore 210. As shown in FIG. 3, choke 204 is coupled to actuator 108. In other embodiments, choke 204 (and actuator 108) may be disposed anywhere suitable to the design and space limitations of choke block 106 along vertical flow bore 210. While FIG. 3 shows choke 204 as being located at a junction between flow bore 210 and lower conduit 208, in other embodiments, choke 204 may be disposed anywhere along conduit 208 of choke block 106.

Choke 204 may include a choke insert in one or more embodiments. In some embodiments, the choke insert may be a non-retrievable choke insert. Other embodiments may call for the choke insert to be a retrievable choke insert. Further, choke 204 may be actuated via actuator 108 located on the side of choke block 106. When choke 204 is actuated, as injected fluid flows through choke 204, a pressure drop may occur and the flow rate of the flowing fluid may be reduced.

Injected fluid may continue to flow through lower conduit 208 of choke block 106, which is aligned with lower conduit 207 of master block 220. The injected fluid may then be directed to flow from lower conduit 207 into flow bore 218. The injected fluid flows through master valve 216 (which was previously opened) and continues its path down flow bore 218 into the injection well 310.

In one or more embodiments, wellhead 308 may be coupled to injection well 310. While FIG. 3 shows one illustrative embodiment of an injection well, those of ordinary skill in the art will appreciate that alternate configurations for an injection well may be used as known in the art. In one embodiment, injection well 310 is created as a bore drilled into a subterranean formation (either onshore or offshore). Cemented casing 312 has been placed to protect the subterranean formation and also to provide a structure for injection well 310. An annulus, i.e. annulus 314, is firmed between the cemented casing 312 of injection well 310 and tubular 316. As understood in the art, casing 312 may be one or more sections of tubulars or pipe placed in the borehole of the well 310 after the bore hole of well 310 is drilled. In one or more embodiments, casing 312 may include one or more tubulars of various diameters coupled to each other and extending into the well 310. Further, it is also envisioned that a tree of the present disclosure may be used in an open hole as well as in the described cased borehole. Tubular 316 extends through the wellbore for providing injection fluids to the reservoir 318.

In one or more embodiments, flow bore 324, which is defined by tubular 316, may be in fluid communication with flow bore 218 of subsea tree 102. Thus, as the injected fluid flows in a downward direction through flow bore 218, the injected fluid may be conducted into flow bore 324 of tubular 316. In one or more embodiments, upon reaching the perforated interval of casing 312, the injected fluid may pass through one or holes (i.e. perforations) created in the formation and also in casing 312. Accordingly, in one or more embodiments, the injected fluid may pass through one or more perforations 320 into reservoir 318. Thus, a method is presented for injecting fluids from a top opening of a subsea tree 102 down into reservoir 318. Further, the fluid flow may be controlled and the pressure regulated using a choke block 106 and one or more chokes, such as choke 204 that are disposed along the fluid flow path. It is noted that in one or more embodiments, a fail safe ball valve may be included in injection bore 218 of subsea tree 102

It is noted that in one or more embodiments, wing valve 212 may or may not be utilized. If desired, wing valve 212 may be omitted and the injected fluid directed into the injection well 310 according to the process described above. This may assist to simplify the components and structure of subsea tree 102 as well as reduce costs. However, if so desired, wing valve 212 may be included and the injected fluid directed through wing valve 212 before flowing through flow bore 218 of subsea tree 102 and master valve 216. Alternatively, wing valve 212 may be disposed in choke block 106. For example, wing valve 212 may be disposed in lower conduit 208 of choke block 106.

According to embodiments of the present disclosure, a method for injecting fluid into a reservoir may include injecting fluid through an opening of the subsea tree, whereby the subsea tree may include a flow bore in fluid communication with a flow bore of a well. The method may further include redirecting the injected fluid from the flow bore through a choke disposed in a choke block. In one or more embodiments, the choke block may be disposed on a lateral side of the subsea tree. In one or more embodiments, the choke may be included in a flow passage of the choke block, and further may be included in an upper conduit or a lower conduit of the choke block. The injecting of the fluid may include directing the injected fluid from the choke back into the flow bore of the subsea tree, and routing the injected fluid through the flow bore of the subsea tree into the flow bore of the well. The injected fluid may flow from the well into the reservoir.

Turning to FIG. 4, FIG. 4 shows a diagram of a subsea tree adapted for use with a production well, e.g. production well 410. The production stage is considered one of the most important stages in a well's life, because this stage is when the oil and gas are produced. Subsea tree 102 may be used to regulate pressures, control flows, and also allow access downhole to the production well 410, as further described below. A method according to one or more embodiments is further described below.

In one or more embodiments, wellhead 308 is coupled to the production well 410, and subsea tree 102 may be landed above or coupled to wellhead 308. Flow bore 324 may be in fluid communication with the flow bore 218 of subsea tree 102. Those of ordinary skill in the art will appreciate that additional tubing or components may be present as part of the overall structure and operation of production well 410.

As shown by the arrows meant to indicate the direction of fluid flow, in one or more embodiments, reservoir fluid may be directed to flow up tubular 316 from reservoir 318 through one or more perforations 320. More specifically, the reservoir fluid may be directed or encouraged to flow through the perforations 320, into annulus 314, and into flow bore 324 using any techniques known in the art. As understood in the art, in many wells, the natural pressure of a reservoir, such as reservoir 318, may be high enough for the hydrocarbons contained in the reservoir to flow to the surface. If this is not the case, then other artificial lift methods may be used. In one or more embodiments, artificial lift methods may also be utilized to induce flow of oil and/or gas from reservoir 318 into flow bore 324. Techniques known in the art for inducing the flow of hydrocarbons contained in reservoir 318, include, without limitation, using downhole pumps, gas lifts, or surface pump jacks.

As part of the production process, in accordance with one or more embodiments, swab valve 214 may be closed prior to the directing of the reservoir fluid out of reservoir 318 and master valve 216 may be opened. Thus, swab valve 214 may act as a bypass valve or diverter valve to cause the reservoir fluid to flow through a specified flow path, i.e., through choke 204. Alternatively, in other embodiments, a plug may be used instead of swab valve 214 to divert flow through choke 204 of choke block 106.

Upon flowing up through flow bore 324, the reservoir fluid may continue to flow upwardly into flow bore 218 of the subsea tree 102. The reservoir fluid may flow through master valve 216 and may be directed to flow through lower conduit 207 disposed in master block 220 of subsea tree 102. The reservoir fluid may flow from lower conduit 207 and into choke block 106 via lower conduit 208 of choke block 106.

The reservoir fluid may then be directed to flow up the vertical choke flow bore 210 to reach choke 204, which is disposed in upper conduit 206. As shown in FIG. 4, choke 204 may be disposed at a junction of upper conduit 206 and flow bore 210 in choke block 106. In other embodiments, choke 204 may be disposed anywhere along upper conduit 206 of choke block 106. Further, in other embodiments, choke 204 and actuator 108 may be disposed anywhere along a vertical flow passage 210 of choke block 106. In one or more embodiments, the choke 204 includes a retrievable choke insert. As shown in FIG. 4, actuator 108 is disposed on a lateral side of choke block 106 and choke 204 is coupled to actuator 108. When choke 204 is actuated, as reservoir fluid flows through choke 204, a pressure drop may occur and the flow rate of the flowing fluid may be reduced.

After passing through choke 204, the fluid may be directed to flow from upper conduit 206 to upper conduit 205 in master block 220 of subsea tree 102, where the reservoir fluid may be directed back into the main vertical flow bore 218 of subsea tree 102 and up towards flow hub 104. From flow hub 104, the flow of the reservoir fluid may be directed to a distribution network of various pipelines and tanks for collection or further refinement.

In one or more embodiments wing valve 212, as used with production well 410, may be omitted from the structure and operation of subsea tree 102. Alternatively, wing valve 212 may be included for directing fluid through wing valve 212 prior to the fluid flowing into choke block 106. Wing valve 212 thus may act as an additional "safety" valve used to control and regulate the flow of reservoir fluid from reservoir 318. Choke 204 disposed in choke block 106 may be very helpful in regulating and controlling flow, but some operators may desire the inclusion of wing valve 212, particularly during production, to have additional means of restricting or regulating the flow of fluids. In other embodiments, wing valve 212 may be disposed in the choke block 106 instead of in the master block 220 as shown in FIG. 4.

In accordance with one or more embodiments of the present disclosure, a method for producing reservoir fluid from a production well may include directing the reservoir fluid from the reservoir through a flow bore of a subsea tree, whereby the flow bore is in fluid communication with the flow bore of a tubular in the production well. A method may further include directing the reservoir fluid from the flow bore through a choke disposed in a choke block. In one or more embodiments, the choke block may be disposed on a lateral side of the subsea tree. Further, the choke may be disposed in an upper conduit or upper flow passage of the choke block. A method may further include directing the reservoir fluid from the choke back into the flow bore of the subsea tree and routing the reservoir fluid from the flow bore of the subsea tree to an opening of the subsea tree.

In one or more embodiments, flow line jumper 302 may be connected to subsea component 304, where the reservoir fluid may be further distributed to various collection sites. Thus, in accordance with one or more embodiments, a method is presented and illustrated in FIG. 4 for providing a flow path to allow for recovery of reservoir fluid originating from reservoir 318 using the components and fluid flow configuration of subsea tree 102.

In one or more embodiments, it may be feasible to readily convert a subsea tree 102 operable with an injection well to that of a production well and vice versa. As shown in FIG. 3 and FIG. 4, the components of subsea tree 102 when used for an injection well or a production well may be the same or substantially similar, which may facilitate using the same subsea tree for either an injection well or a production well. As previously discussed, different sized hubs may be used with a same subsea tree 102. Further, different chokes may be used in a choke block 106. Those of ordinary skill may appreciate that choke 204 may be replaced with different types and sizes of chokes. As noted above, if reducing the amount of downtime that may occur if a choke, such as choke 2014, requires repair or maintenance is of concern, then a retrievable choke insert may be utilized in a choke block 106 of a subsea tree instead of a non-retrievable choke insert.

The present disclosure further provides different embodiments and methods so that a single subsea tree may be configured to operate in conjunction with either an injection well or a production well. In one or more embodiments, a subsea tree that has been used as a "production subsea tree" in conjunction with a production well (e.g. 410 in FIG. 4) may be used as an injection tree (e.g., 310 in FIG. 3) or a subsea tree that has been used as an "injection tree" may be used as a production tree.

For example, in one or more embodiments, choke 204 may be reoriented and flow through the choke 204 reversed. The flow through the choke 204 may be reversed by opening and/or closing one or more valves. In one or more embodiments, choke 204 may be reconfigured, reoriented, or moved from an upper flow passage (e.g. upper conduit 206) of choke block 106 to a lower passage (e.g. lower conduit 208) of choke block 106. Actuator 108 may also be moved to be aligned with and attachable to choke 204 if choke 204 is moved from its original position.

According to one embodiment, if subsea tree 102 is used as a production subsea tree, after repositioning choke 204 and/or actuator 108 from an upper flow passage of choke block 106 to a lower flow passage of choke block 106, subsea tree 102 may be used as an injection well by injecting fluid into flow hub 104 and down into subsea tree 102 following the same flow path discussed above in FIG. 3. Accordingly, swab valve 214 may be closed and master valve 216 opened. Fluid injected into flow bore 218 may then flow into conduits 205 and 206 of choke block 106 to flow through choke 204 and continue in the same manner as discussed above in FIG. 3. In one or more embodiments, the fluid injected into subsea tree 102 may be a different fluid than the fluid produced from a well located below the subsea tree 102 when subsea tree 102 was used as a production subsea tree.

Conversely, if subsea tree 102 is used as an injection subsea tree, choke 204 and/or actuator 108 may be repositioned from a lower flow passage (e.g., 208) of choke block 106 to an upper flow passage (e.g., 206) of choke block 106. Subsea tree 106 may thus be configured to operate in conjunction with a production well in accordance with the one or more embodiments discussed previously with respect to FIG. 4

In one or more embodiments, the choke block 106 may be removed and replaced with another choke block that has a choke 204 and actuator 108 positioned in the appropriate conduit of choke block, depending on whether subsea tree 102 may be used for production services or injection services. Further, in one or more embodiments, one type of choke may be used while injecting fluid into subsea tree 102 and a second type of choke may be used while producing fluids from subsea tree 102. Thus, a replacement choke block may include a particular type or configuration of a choke used for the particular fluid and/or particular process.

In one or more embodiments, the flow of fluid through the choke block may be reversed, which may further include reversing a direction of fluid flow through the same choke disposed in the choke block that was previously used when flow was not reversed. Accordingly, instead of directing fluid upwardly from a production well, fluid may be injected into flow hub 104 at the top of subsea tree 102 so that the injected fluid flows into subsea tree 102 and follows the injection route described above in FIG. 3. Reversing fluid flow through a choke configured for production may only allow a percentage of full flow therethrough, however, the reversed flow allows a subsea tree 102 used for production to be used also as an injection subsea without having to rearrange, reorient, reposition, or move the choke block 106, choke 204, and/or actuator 104. In other embodiments, fluid flow may be reversed and the choke block 106 may be replaced or individual components such as, without limitation, choke 204 and actuator 108 may be replaced.

According to one or more embodiments of the present disclosure, a method for operating a subsea tree includes flowing a first fluid produced from a flow bore of a well in an upwards direction through a flow bore of the subsea tree. The method may further include flowing the first fluid from the flow bore of the subsea tree through a choke disposed in a choke block, whereby the choke block is disposed on a lateral side of the subsea tree, and flowing the first fluid from the choke block to the flow bore of the subsea tree. The first fluid may then be directed upwardly towards a top opening of the subsea tree. A method may include reversing a direction of flow through the subsea tree. The reversing may further include injecting a second fluid into the top opening of the subsea tree, flowing the second fluid down through the flow bore of the subsea tree to the choke block, flowing the second fluid through the choke in the choke block, and flowing the second fluid from the choke block to the flow bore of the subsea tree and down into the flow bore of the well. Reversing the direction of the flow through the subsea tree may further include reversing the flow of the fluid so that the fluid flows through the choke in the choke block.

In the life of a well, whether an injection or a production well, a workover may become necessary. When access may be required downhole, (e.g. as in the case of a workover), it may not be necessary to remove the subsea tree 102 entirely, instead, in accordance with one or more embodiments, swab valve 214 and master valve 216 may be opened and access may be achieved to the downhole flow bores by going through the flow bore 218 of subsea tree 102. Any wireline operations and invasive techniques into the downhole well may have access through subsea tree 102 in this manner.

It is further noted that one or more flow meters and sensors may be disposed at various locations on subsea tree 102. For example, in one or more embodiments, one or more flow meters (which measure and monitor various characteristics of a fluid) may be integrated into choke block 106 and disposed upstream of choke 204. In other embodiments, one or more flow meters may be disposed along vertical flow bore 218 of subsea tree 102. Those of ordinary skill may appreciate that a flow meter may be disposed in alternative configurations other than those described above.

While not explicitly illustrated in the figures, it is noted that in one or more embodiments, subsea tree 102 may include an annulus passageway and corresponding annulus control valves, such as an annulus swab valve for controlling flow through the annulus passage way, such as annulus 314. Further, in one or more embodiments, a fail safe check valve may be included in annulus 314. Additionally, subsea tree 102 may include a crossover valve for controlling flow through a crossover passageway connecting the annulus passageway of subsea tree 102 to a well annulus, such as annulus 314. One or more chemical injection lines may also be provided with subsea tree, U.S. Pat. No. 7,296,629, incorporated herein for reference in its entirety and assigned to the present assignee, includes further detailed description about these additional components that may be configured to operate with one or more embodiments of subsea tree 102 as presented herein. It is noted that in one or more embodiments, the valves on subsea tree 102 may be manually operated.

Embodiments disclosed herein may provide for a subsea tree that may be adapted for use with either an injection well or a production well. The different embodiments described herein disclose a subsea tree that may have a smaller footprint, i.e., takes up a reduced amount of valuable and limited space on an oil and gas drilling site, by virtue of being a vertical subsea tree. Further, as oil and gas companies look to lower costs in an economically challenging environment, a subsea tree in accordance with one or more embodiments herein may provide a cost effective solution. When utilized as a subsea tree for water injection services, the subsea tree described above in one or more embodiments may require less maintenance when compared with more complicated and conventional designs for some existing subsea trees. Further, as shown in one or more illustrative embodiments, the top flow opening removes the need for costly flowloops and framework as compared with other design configurations of subsea trees, whether the subsea tree is adapted for use with either an injection well or a production well. Additionally, one or more embodiments described herein may remove the need for a dedicated tree cap for use typically seen on existing subsea tree systems. Thus, the design configuration of a subsea tree as described in one or more embodiments herein may reduce overall costs for oil and gas companies because of the lower maintenance and lower cost design of the subsea tree. Further, one or more embodiments provided herein may allow for the keeping of a common tree for both injection and well production services.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A subsea tree configured for use with a well, comprising:

a flow bore configured to establish fluid communication with the well when the subsea tree is installed;

a flow hub in fluid communication with the flow bore and configured to allow fluid communication with the well through the subsea tree;

a block coupled to and non-retrievable from the subsea tree when the subsea tree is installed;

a conduit disposed in the block and in fluid communication with the flow bore; and a choke disposed in the conduit and the block;

wherein the choke comprises a retrievable choke insert that is oriented horizontally with respect to the subsea tree and is independently retrievable from the block when the subsea tree is installed, and wherein a reservoir fluid flowing through the flow bore is directed through the choke and the flow hub.

2. The subsea tree of claim 1, wherein the retrievable choke insert is a self-contained package.

3. The subsea tree of claim 2, wherein the self-contained package further comprises a trim, an actuator, and/or a retention mechanism of the choke.

4. The subsea tree of claim 2, wherein the self-contained package is replaceable, removable, or repairable without removing the subsea tree.

5. The subsea tree of claim 1, wherein the subsea tree is a production tree or an injection tree.

6. The subsea tree of claim 1, wherein the flow bore comprises a vertical flow bore positioned within a master block of the subsea tree.

7. The subsea tree of claim 6, wherein the block comprises an upper conduit and a lower conduit, wherein the upper conduit and the lower conduit are each oriented horizontally with respect to the vertical flow bore, and wherein the choke is disposed in the upper conduit.

8. The subsea tree of claim 7, wherein the master block further comprises an upper conduit and a lower conduit that are in direct fluid communication, respectively, with the upper and lower conduits of the block.

9. The subsea tree of claim 6, wherein the block comprises an upper conduit and a lower conduit, wherein the upper conduit and the lower conduit are each oriented horizontally with respect to the vertical flow bore, and wherein the choke is disposed in the lower conduit.

10. The subsea tree of claim 1, further comprising a valve disposed in the flow bore and configured to be selectively closed so that fluid flowing through the flow bore is directed through the choke.

11. A method for operating a subsea tree, comprising:

flowing a reservoir fluid produced from a flow bore of a well in an upwards direction into a flow bore of the subsea tree;

flowing the reservoir fluid from the flow bore of the subsea tree through a choke disposed in a conduit in fluid communication with the flow bore, wherein the conduit and the choke are disposed in a block coupled to and non-retrievable from the subsea tree;

restricting the flow of the reservoir fluid with a retrievable choke insert of the choke, wherein the retrievable choke insert is oriented horizontally with respect to the subsea tree;

flowing the reservoir fluid from the choke to a flow hub in fluid communication with the flow bore and configured to allow fluid communication with the well through the subsea tree; and retrieving the retrievable choke insert independently from the block.

12. The method of claim 11, further comprising disassembling the retrievable choke insert from the block while the block is coupled to the subsea tree.

13. The method of claim 12, further comprising pulling the retrievable choke insert up to a surface for troubleshooting purposes or removal or replacement.

14. The method of claim 12, further comprising retrieving at least one of a trim, an actuator, and a retention mechanism of the choke up to a surface for troubleshooting purposes or removal or replacement.

15. A method for operating a subsea tree, comprising:

injecting a fluid through an opening of a master block, wherein the master block includes a flow bore in fluid communication with a flow bore of a well;

flowing the injected fluid from the flow bore of the master block through a choke disposed in a conduit connected to the master block and in fluid communication with the flow bore of the master block;

restricting the flow of the injected fluid with a retrievable choke insert of the choke, wherein the retrievable choke insert is oriented horizontally with respect to the subsea tree;

flowing the injected fluid from the choke to the flow bore; and retrieving the retrievable choke insert independently from the conduit.

16. The method of claim 15, further comprising disassembling the retrievable choke insert from the conduit while the conduit is disposed in a choke block and the choke block is coupled to the subsea tree.

17. The method of claim 16, further comprising pulling the retrievable choke insert up to a surface for troubleshooting purposes or removal or replacement.

18. The method of claim 16, further comprising retrieving at least one of a trim, an actuator, and a retention mechanism of the choke up to a surface for troubleshooting purposes or removal or replacement.

19. The method of claim 15, further comprising routing the injected fluid through the flow bore of the master block into the flow bore of the well.

* * * * *